US005247715A

United States Patent [19]

Nishiguchi

[11] Patent Number: 5,247,715

[45] Date of Patent: Sep. 28, 1993

[54] MULTIPLE USE SPANNER TOOL

[75] Inventor: Laurence E. Nishiguchi, Ewa Beach, Hi.

[73] Assignee: The United States of America as represented by the Secretary of the Navy, Washington, D.C.

[21] Appl. No.: 828,543

[22] Filed: Jan. 27, 1992

[51] Int. Cl.[5] ..... B25B 13/00

[52] U.S. Cl. ..... 7/138; 81/100; 81/176.15; 7/166

[58] Field of Search ..... 7/138, 139, 140, 146, 7/166; 81/100, 110, 176.15

[56] References Cited

U.S. PATENT DOCUMENTS

| | | | |
|---|---|---|---|
| 292,168 | 1/1884 | Lytle | 7/138 |
| 788,772 | 5/1905 | Johnson | 81/100 |
| 1,207,046 | 12/1916 | Howard | 81/176.1 |
| 3,641,846 | 2/1972 | Prial | 81/90 F |
| 4,597,123 | 7/1986 | Cobe, Jr. | 7/138 |
| 4,646,378 | 3/1987 | Borden | 7/140 |
| 4,924,544 | 5/1990 | Culotta | 7/138 |

*Primary Examiner*—James G. Smith

*Attorney, Agent, or Firm*—Harvey Fendelman; Thomas Glenn Keough

[57] ABSTRACT

An adjustable spanner wrench and combination tool for use by firefighters is provided. An elongate handle has first and second ends between which a variety of firefighter's tools are defined. A first jaw portion is affixed on one end thereof to one end of the handle. The first jaw portion extends from the one end thereof as a pair of spaced apart generally parallel side walls. A first end of a second jaw portion is movably fitted between the parallel side walls of the first jaw portion. The second jaw portion is further provided with an elongate slot having a plurality of slot projections extending therefrom. A hinge pin is affixed between the parallel side walls of the first jaw portion and passes through the elongate slot of the second jaw portion. In this way, the second jaw portion may be selectively positioned by allowing the hinge pin to come to rest in one of the plurality of slot projections. Also, the second jaw portion is free to rotate about the hinge pin through an angle of approximately 270°. In this way, the first and second jaw portions may grip a firefighting apparatus coupling to form a line of compressive force that falls before a turning axis of the firefighting apparatus coupling regardless of the coupling's size and/or design.

25 Claims, 3 Drawing Sheets

MULTIPLE USE SPANNER TOOL

FIELD OF THE INVENTION

The present invention relates to the field of spanner wrenches used in firefighting coupling operations, and more particularly to a multiple use spanner tool that is operable with a wide variety of coupling types and sizes while also serving as a multiple use tool for a variety of firefighting operations.

BACKGROUND OF THE INVENTION

In the field of firefighting, spanner wrenches are used to tighten and loosen firefighting apparatus couplings. Couplings vary in size and design depending on their function and/or manufacturer. For example, a typical firefighting job might require a fireman to work with couplings ranging from 1¼ inches in diameter to 3½ inches in diameter. At the same time, coupling designs encountered during the job may vary to include a pin-type as shown in the cross-section of FIG. 1(*a*), a lug-type shown in the cross-section of FIG. 1(b), a squared lug-type shown in the cross-section of FIG. 1(*c*), and/or a recessed hole-type shown in the cross-section of FIG. 1(*d*). Naturally, it is desirable that a fireman only carry a single spanner wrench that works with all of the above designs and sizes.

Accordingly, prior art spanner wrench tools for firefighting are designed with either a fixed jaw or a movable jaw pivotable about a single hinge point to accommodate the largest coupling diameter that will be encountered. In either case, however, the effectiveness of these wrenches diminishes as the size of the coupling decreases. Furthermore, use of these wrenches can damage the smaller couplings over a period of time For a better understanding of this problem, reference is made to FIG. 2 where a prior art spanner wrench 10 is shown from a side view and positioned on a smaller (e.g. 1¼ inch diameter) lug-type coupling 20.

As is readily apparent, a jaw 12 includes a square tooth 14 for catching on a lug 22 of coupling 20. As a user applies a force in the direction of arrow A on a handle 16, a turning force results in the direction of arrow B. Simultaneously, a compressive force indicated by arrow C is exerted on coupling 20 and is a force proportional to that applied by arrow A. The line of force, created by the force at arrow C and indicated by dashed line 30, falls after the center 24 of coupling 20. This results in compression of coupling 20 which causes tooth 14 to slip from lug 22. Furthermore, since many couplings are made from brass or aluminum alloys, the lugs wear down over time under this type of compressive force thereby increasing the chance that the spanner wrench will slip from the lug.

Thus, the need exists for a spanner wrench that is effective with a wide variety of coupling sizes and designs, and more specifically for a spanner wrench that is especially effective in the hurried environment of fire or rescue emergencies. Therefore, an object of the present invention is to provide a spanner wrench for firefighters that may be adjusted to function with a range of coupling sizes and designs without damaging the couplings over time. In addition, it is desirable that a spanner wrench be useful to a firefighter for other operations that typically require crescent wrenches, a hammer, screwdrivers, etc. Accordingly, another object of the present invention is to provide a spanner wrench for firefighters that also incorporates a plurality of other tools commonly used by firefighters thereby resulting in a spanner wrench and combination tool for firefighters.

SUMMARY OF THE INVENTION

In accordance with the present invention, an adjustable spanner wrench and combination tool for use by firefighters is provided An elongate handle has first and second ends. The first end of the handle terminates in a wedge shape for purposes of prying and further defines an open-end wrench socket having a width transverse to the handle. The handle further defines: 1) a plurality of specifically sized holes serving as box-end wrench sockets between the first and second ends of the handle, 2) a trapezoidal open-end wrench socket having a width parallel to the handle, and 3) a hammer integral with the handle in proximity of the second end thereof. A first jaw portion is affixed on one end thereof to one end of the handle. The first jaw portion extends from the one end thereof as a pair of spaced apart generally parallel side walls. A second jaw portion has first and second ends. The first end of the second jaw portion is movably fitted between the parallel side walls of the first jaw portion. The second jaw portion is further provided with an elongate slot cut therethrough. The elongate slot further has a plurality of slot projections extending therefrom. A hinge pin is affixed between the parallel side walls of the first jaw portion and passes through the elongate slot of the second jaw portion. In this way, the second jaw portion may be selectively positioned by allowing the hinge pin to come to rest in one of the plurality of slot projections. Also, the second jaw portion is free to rotate about the hinge pin through an angle of approximately 270°. In this way, the first and second jaw portions may grip a firefighting apparatus coupling to form a line of compressive force that falls before a turning axis of the firefighting apparatus coupling.

DESCRIPTION OF THE PREFERRED EMBODIMENT

Figure 3:
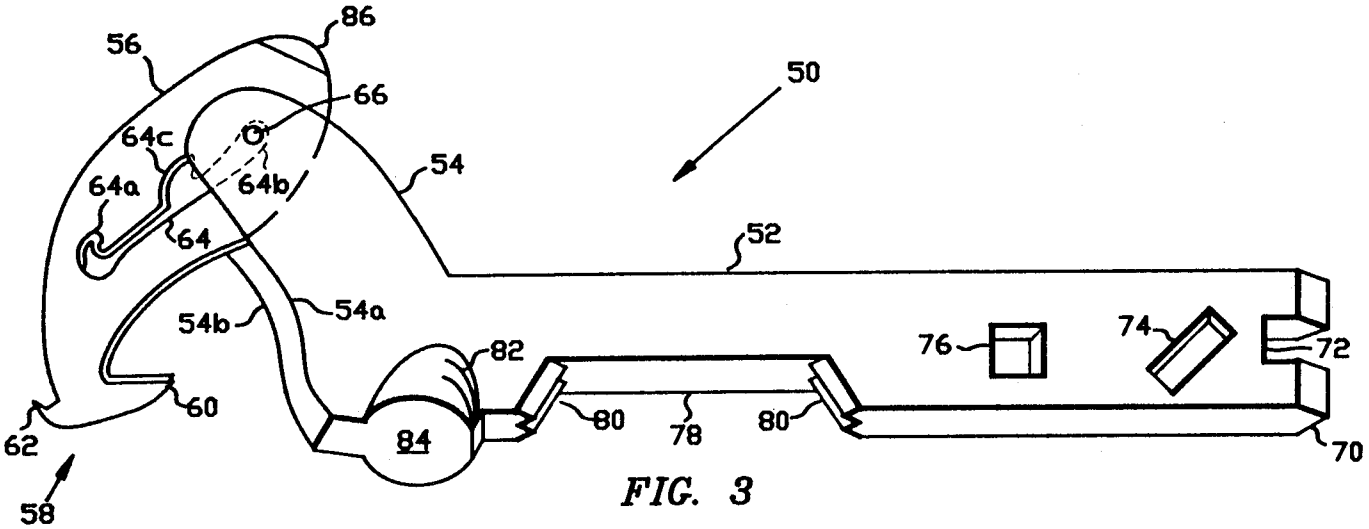
FIG. 3 is a perspective view of the multiple use spanner tool according to the present invention.

Referring now to the drawings, and in particular to FIG. 3, a perspective view of the spanner wrench and combination tool according to the present invention is shown and is referenced generally by numeral 50. With respect to the spanner wrench function of the present invention, a long handle 52 is provided and is fixedly attached or integral with a first jaw portion 54. First jaw portion 54 comprises side walls 54*a* and 54*b* which oppose each other in a parallel (or substantially parallel) relationship.

Fitted and movable between side walls 54a and 54b is a second jaw portion 56. At its free end 58, second jaw portion 56 has an inwardly angled projection 60. Furthermore, for reasons that will be explained hereinbelow, projection 60 could be Y-shaped as shown. This Y-shape is particularly useful when a firefighting apparatus coupling is a pin, lug or squared lug-type coupling. In addition, pointing away from the arcuate shape of second jaw portion 56 is a hooked pin 62 for use with recessed hole-type couplings as will be explained further hereinbelow.

Cut through second jaw portion 56 is an elongated slot 64 having at least two slot projections 64a and 64b at either end thereof. However, as will be readily apparent to one skilled in the art, more slot projections may be provided along the length of slot 64 as evidenced by slot projection 64c. The purpose of slot 64 and its projections 64a, 64b and 64c is to define the position and movement of second jaw portion 56 with respect to first jaw portion 54 and handle 52. Accordingly, a hinge pin 66 is fixedly attached between side walls 54a and 54b, and further passes through slot 64. Note that slot projections 64a, 64b and 64c have been angled slightly from slot 64 to provide a resting place for hinge pin 66.

Figure 2:
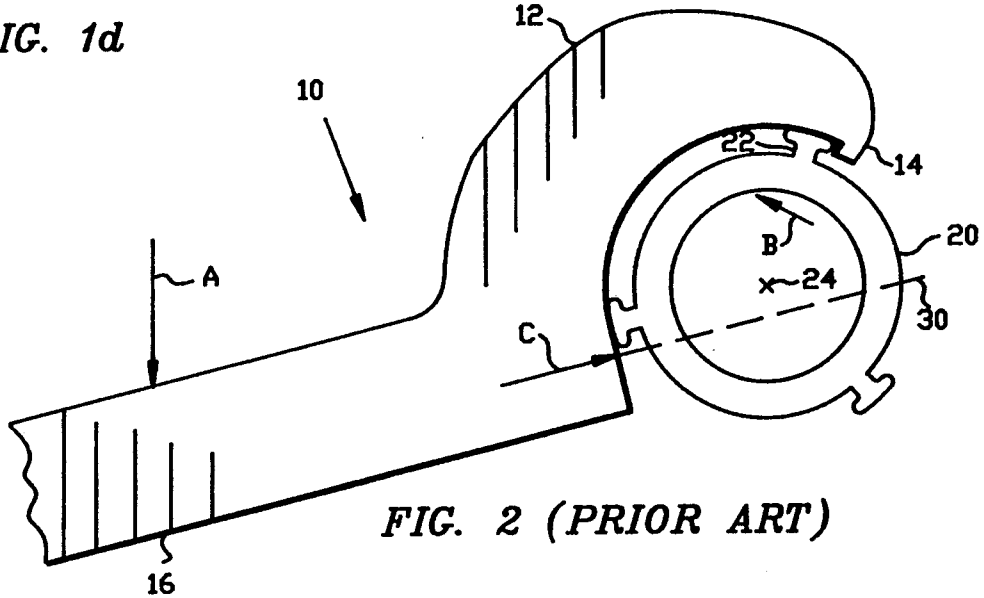
FIG. 2 (PRIOR ART)
FIG. 2 is side view of a prior art spanner wrench positioned on lug-type coupling.
Figure 1A:
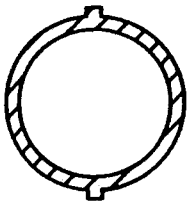
FIGS. 1(*a*)–1(*d*) are cross-sectional views of conventional pin-type, lug-type, squared lug-type and recessed hole-type couplings, respectively, used in firefighting apparatus applications.
Figure 1B:
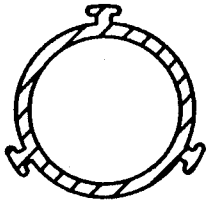
Figure 1C:
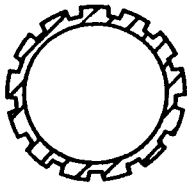
Figure 1D:
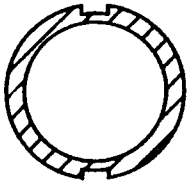
Figure 4:
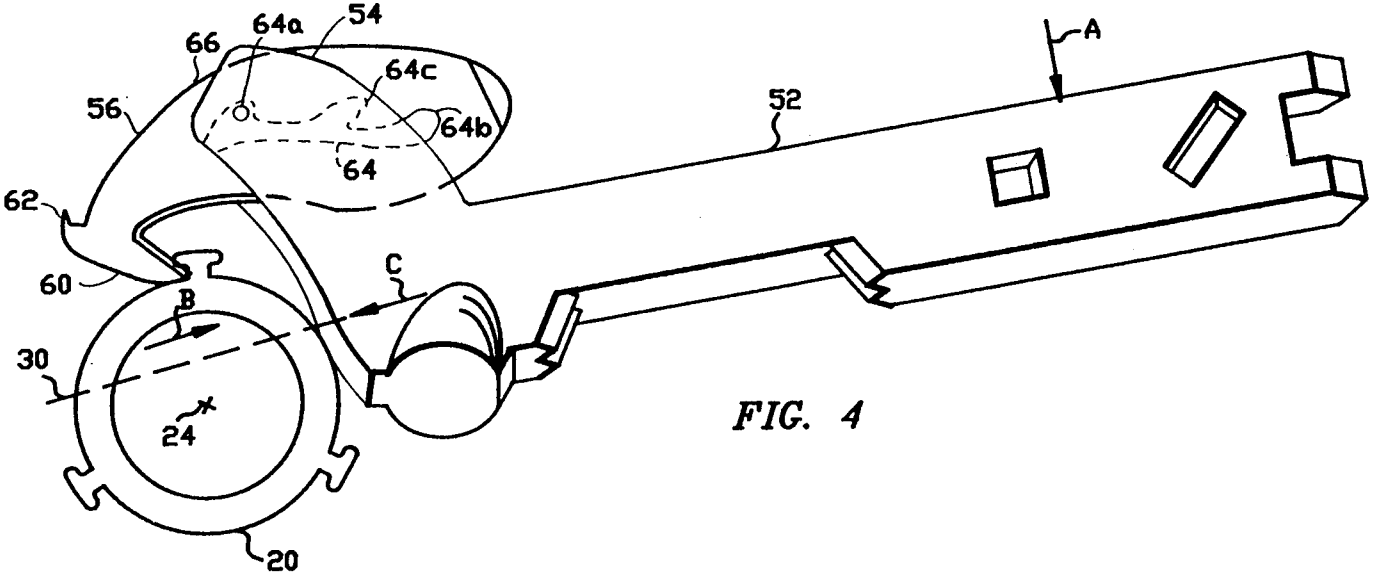
FIG. 4 is a perspective view of the multiple use spanner according to the present invention positioned on a lug-type coupling.

The operation and inherent advantages of the spanner wrench function of the present invention will now be described with reference to FIGS. 4 and 5. For ease of understanding, common reference numerals will be used for common elements. In FIG. 4, first and second jaw portions 54 and 56 cooperate as shown to engage the same size lug-type coupling 20 as shown in FIG. 2. For smaller sized couplings, second jaw portion 56 is positioned such that hinge pin 66 comes to rest in slot projection 64a as shown. As a user applies a force in the direction of arrow A on handle 52, a turning force results in the direction of arrow B. Similar to FIG. 2, a compressive force indicated by arrow C is exerted on coupling 20. However, the line of force (indicated by dashed line 30) created by the force at arrow C falls before the center 24 of coupling 20. With force line 30 falling before the center 24, projection 60 does not slip off lug 22 when force A is applied. Furthermore, the Y-shape of projection 60 allows the projection to center itself and positively engage lug 22.

Figure 5:
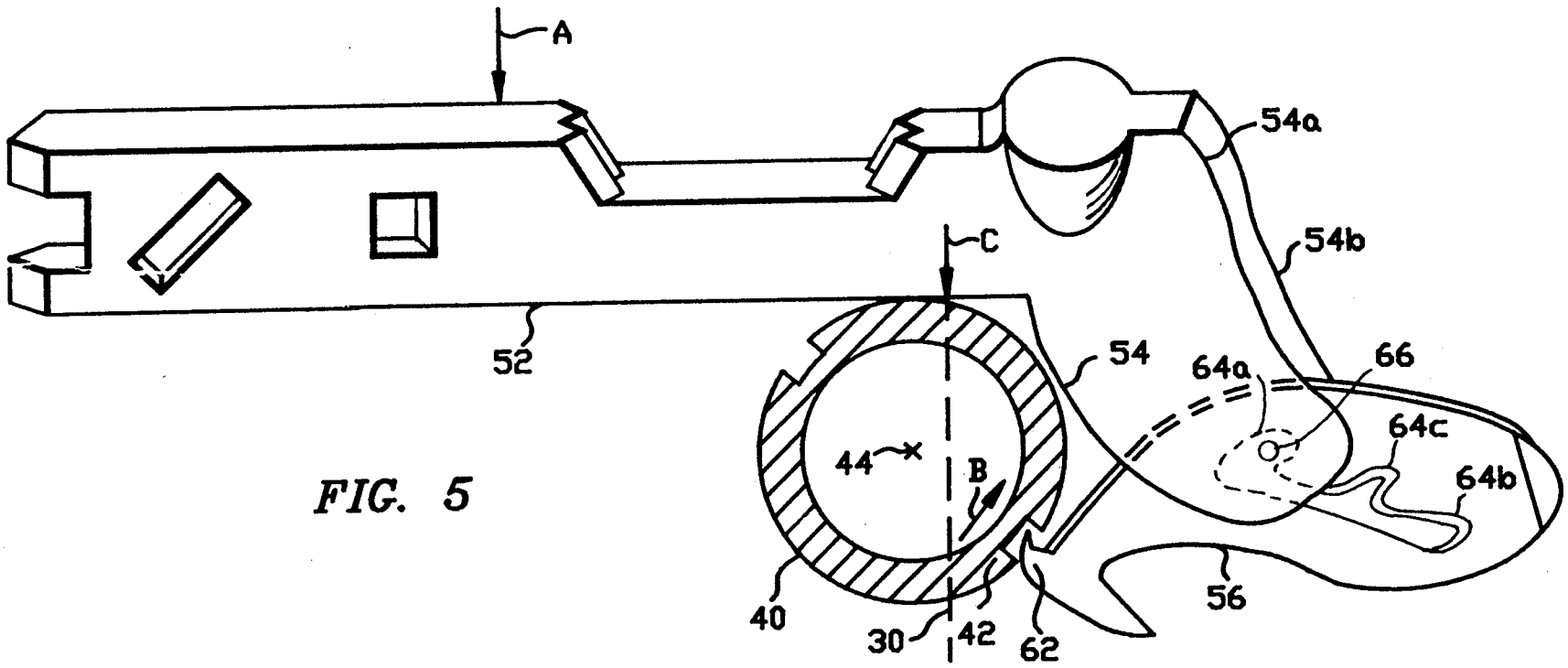
FIG. 5 is a perspective view of the multiple use spanner tool according to the present invention positioned on a recessed hole-type coupling.

In FIG. 5, first and second jaw portions 54 and 56 cooperate as shown to engage a recessed hole-type coupling 40 sized similar to that of the lug-type coupling shown in FIGS. 2 and 4. In particular, hooked pin 62 engages a recessed hole 42 of coupling 40 (shown in cross-section). To do so, second jaw portion 56 rotates about hinge pin 66 such that round pin 62 is angled inward toward first jaw portion 54. This is made possible by the approximate 270° of rotation freedom between first and second jaw portions 54 and 56. For the smaller sized recessed hole couplings, second jaw portion 56 is positioned such that hinge pin 66 comes to rest in slot projection 64a as shown. Similar to the lug-type coupling operation, a user applies force on handle 52 in the direction of arrow A to generate a turning force in the direction of arrow B. The compressive force C, proportional to user force A, is exerted on coupling 40 and generates a line of force 30 that falls before the center 44 of coupling 40. Once again, since force line 30 falls before the center 44, hooked pin 62 does not pop out from recessed hole 42 as force A is applied to handle 52. Furthermore, the hooked shape of pin 62 adds gripping action as force A is applied.

Referring again to FIG. 3, the combination tool capabilities of the present invention will now be described. Handle 52 is tapered to form a wedged shape tip 70 which may be used for prying purposes. Cut out from tip 70 is an open-end socket 72 that is typically a ½ inch open-end socket for loosening nuts such as battery cable terminal nuts (not shown). Tip 70 could also be used in cooperation with handle 52, for example, to pry a battery cable from its terminal.

Handle 52 can further be used to define a variety of box-end wrenches which, by way of example only, are represented by box-end wrenches 74 and 76. As shown, box-end wrench 74 is cut to fit a gas utility key (not shown) and is therefore ¼ inch wide by ⅜ inches long. Furthermore, the longitudinal axis of box-end wrench 74 is offset from the longitudinal axis of handle 52 by 45°. This offset allows the wrench to be used in confined spaces where only a quarter turn is possible. In these situations, handle 52 is flipped over to permit re-engagement by box-end wrench 74 with the gas utility key. Box-end wrench 76 is square and might be typically sized as a ⅜ inch square to engage, for example, a compressed gas cylinder key (not shown).

Handle 52 may also be used to define a trapezoidal open-end wrench socket 78. The trapezoidal shape allows socket 78 to engage round tops, such as those found on 5 gallon aqueous film forming foam (A.F.F.F.) containers (not shown), in order to aid in opening same. This particular tool capability is important for two reasons. First, it is often necessary to open as many as 100 of these 5 gallon containers per firefighting vehicle. Secondly, because of the soapy nature of A.F.F.F., opening these containers becomes increasingly difficult over time.

Accordingly, sizing of socket 78 to fit these container tops requires that the base of the trapezoidal socket be 3 inches. To provide the "bite" needed to grip such tops, socket 78 is further provided with grooves 80 cut into the sides thereof. In operation, a user would place socket 78 over a top to be opened, firmly press handle 52 down so that grooves 80 bite into the top, and then appropriately turn handle 52.

Handle 52 might also define a hammer head 82 having a flat, generally circular face 84. Face 84 is typically angled slightly (approximately 20°) with respect to handle 52 to protect a user's fingers when the present invention is utilized as a hammer. Finally, second jaw portion 56 could be tapered at the outward curved portion thereof as indicated by reference numeral 86. Tapered portion 86 could thus be used as a head of a screwdriver as second jaw portion 56 is folded into first jaw portion 54. Correct sizing of tapered portion 86 would allow it to engage, for example, the inner portion of 55 gallon A.F.F.F. caps (not shown) and/or aircraft Zuess keys (not shown).

The advantages of the present invention are numerous. By providing multiple hinge points, the spanner wrench of the present invention may be configured to make the compressive forces acting on a coupling occur before the center of the coupling. This results in an excellent transfer of body energy into mechanical energy. Thus, less body energy is required while that which is expended is applied in the proper direction. The application of a reduced amount of energy in the correct places reduces the chance that the wrench jaws will slip off the lugs. This not only increases the effectiveness of the wrench, but also increases the effective life of the coupling. In addition, the variety of firefighting tools incorporated into the present invention's design greatly reduces the amount of tools that a firefighter must carry. Thus, a firefighter is able to go about his job more quickly and efficiently.

Although the invention has been described relative to a specific embodiment thereof, there are numerous variations and modifications that will be readily apparent to those skilled in the art in the light of the above teachings. For example, the present invention could be made from aluminum or any other strong, lightweight metal alloy. Alternatively, the present invention could be made from a composite with permanently embedded pieces of steel placed appropriately for strength. A composite would typically be chosen based on its strength-to-weight ratio. Furthermore, it may be desirable to choose a material that is non-sparking or non-conductive. Finally, a variety of additional/substitute tool capabilities could be provided as needed. It is therefore to be understood that, within the scope of the appended claims, the invention may be practiced other than as specifically described.

What is claimed as new and desired to be secured by Letters Patent of the United States is:

1. An adjustable spanner tool for use in the turning of fittings or couplings, comprising:

an elongate handle having a first engagement surface for engagement with fittings or couplings;

a first jaw portion affixed to one end thereof to one end of said handle, said first jaw portion extending from the one end thereof as a pair of spaced apart generally parallel side walls, said sidewalls having a second engagement surface for engagement with fittings or couplings;

a second jaw portion having first and second ends, the first end of said second jaw portion being movably fitted between the parallel side walls of said first jaw portion, said second jaw portion being further provided with an elongate slot cut therethrough, the elongate slot further having a plurality of slot projections extending therefrom, said second jaw portion including a first projection extending from the second end of said second jaw portion for cooperation with said second engagement surface for engaging said fittings or couplings, and further including a second projection extending generally away from said first projection for cooperation with said handle first engagement surface for engaging said fittings or couplings; and a hinge pin, affixed between the parallel side walls of said first jaw portion and passing through the elongate slot of said second jaw portion, wherein said second jaw portion may be selectively positioned by allowing said hinge pin to come to rest in one of the plurality of slot projections, and wherein said second jaw portion is free to rotate about said hinge pin through an angle of approximately 270°.

2. A tool as in claim 1 wherein said second jaw portion is arcuately shaped and includes an inwardly angled tooth projection extending from the second end of said second jaw portion for cooperation with protruding lugs on firefighting apparatus couplings, and further includes an integral pin member extending away from the arcuately shaped second jaw portion for cooperation with recessed hole-type firefighting apparatus couplings.

3. A tool as in claim 1 wherein said first projection is shaped so as to grasp protruding lugs on said fittings or couplings.

4. A tool as in claim 1 wherein said second projection is for cooperating with recessed hole type fittings or couplings.

5. A tool as in claim 1 wherein said handle is tapered into a wedge shape at an end of said handle opposite said first jaw portion.

6. A tool as in claim 5 wherein the wedge shaped end of said handle is provided with an open-end slot.

7. A tool as in claim 6 wherein the open-end slot is a ½ inch width slot.

8. A tool as in claim 1 wherein said handle is further provided with a rectangular slot passing therethrough in proximity to an end of said handle opposite said first jaw portion, said rectangular slot having a longitudinal axis angled at 45° with respect to a longitudinal axis of said handle.

9. A tool as in claim 8 wherein said rectangular slot is ¼ inch wide and ¾ inches long.

10. A tool as in claim 1 wherein said handle is further provided with a square hole passing therethrough in proximity to an end of said handle opposite said first jaw portion.

11. A tool as in claim 10 wherein said square hole is a ⅜ inches square hole.

12. A tool as in claim 1 wherein said handle is further provided with an trapezoidal cutout in a central portion thereof, wherein a portion of the handle exposed by the trapezoidal cutout is grooved.

13. A tool as in claim 12 wherein said trapezoidal cutout has a 3 inch base.

14. A tool as in claim 1 wherein said handle includes a substantially cylindrical member depending therefrom and having a flat face angled with respect to a longitudinal axis of said handle.

15. A tool as in claim 1 wherein said second jaw portion includes an integral tapered portion extending away from said first projection whereby the integral tapered portion serves as a screwdriver head.

16. An adjustable spanner wrench and combination tool comprising:

an elongate handle having first and second ends, the first end of said handle terminating in a wedge shape for purposes of prying and further defining an open-end wrench socket having a width transverse to said handle, said handle further defining: 1) a plurality of specifically sized holes serving as box-end wrench sockets between the first and second ends of said handle, 2) a trapezoidal open-end wrench socket having a width parallel to said handle, and 3) a substantially cylindrical member integral with said handle in proximity of the second end thereof, said substantially cylindrical member having a flat face angled with respect to said handle;

a first jaw portion affixed on one end thereof to one end of said handle, said first jaw portion extending from the one end thereof as a pair of spaced apart generally parallel side walls;

a second jaw portion having first and second ends, the first end of said second jaw portion being movably fitted between the parallel side walls of said first jaw portion, said second jaw portion being further provided with an elongate slot cut therethrough, the elongate slot further having a plurality of slot projections extending therefrom; and a hinge pin, affixed between the parallel side walls of said first jaw portion and passing through the elongate slot of said second jaw portion, wherein said second jaw portion may be selectively positioned by allowing said hinge pin to come to rest in one of the plurality of slot projections, and wherein said second jaw portion is free to rotate about said hinge pin through an angle of approximately 270° such that said first and second jaw portions may grip a firefighting apparatus coupling to form a line of compressive force that falls before a turning axis of the firefighting apparatus coupling.

17. A spanner wrench and combination tool as in claim 16 wherein said second jaw portion is arcuately shaped and includes an inwardly angled tooth projection extending from the second end of said second jaw portion for cooperation with protruding lugs on firefighting apparatus couplings, and further includes an integral pin member extending away from the arcuately shaped second jaw portion for cooperation with recessed hole-type firefighting apparatus couplings.

18. A spanner wrench and combination tool as in claim 17 wherein said tooth projection is Y-shaped.

19. A spanner wrench and combination tool as in claim 17 wherein said integral pin member is hooked.

20. A spanner wrench and combination tool as in claim 17 wherein the open-end wrench socket in said handle is a ½ inch socket.

21. A spanner wrench and combination tool as in claim 16 wherein the plurality of specifically sized holes serving as box-end wrench sockets in said handle include:

a rectangular hole having a longitudinal axis angled at 45° with respect to a longitudinal axis of said handle; and a square hole.

22. A spanner wrench and combination tool as in claim 21 wherein said rectangular hole is ¼ inch wide and ¾ inches long.

23. A spanner wrench and combination tool as in claim 21 wherein said square hole is a ⅜ inches square hole.

24. A spanner wrench and combination tool as in claim 16 wherein said trapezoidal open-end wrench socket has a 3 inch base.

25. A spanner wrench and combination tool as in claim 17 wherein said second jaw portion includes an integral tapered portion extending away from the arcuately shaped second jaw portion whereby the integral tapered portion serves as a screwdriver head.

* * * * *